United States Patent [19]

Ditscherlein

[11] Patent Number: 4,850,151

[45] Date of Patent: Jul. 25, 1989

[54] CENTRIFUGAL TREATMENT APPARATUS

[75] Inventor: Friedhold Ditscherlein, Bocholt, Fed. Rep. of Germany

[73] Assignee: Max Spaleck GmbH & Co. KG Max, Fed. Rep. of Germany

[21] Appl. No.: 144,405

[22] Filed: Jan. 15, 1988

[51] Int. Cl.[4] ..... B24B 31/00

[52] U.S. Cl. ..... 51/163.2; 51/164.1; 51/423; 51/434; 134/154; 241/175

[58] Field of Search ..... 51/163.2, 163.1, 164.3, 51/422, 423, 434; 241/175; 134/154, 83; 68/142, 58

[56] References Cited

U.S. PATENT DOCUMENTS

| | | |
|---|---|---|
| 1,457,007 | 5/1923 | Smith . |
| 2,813,376 | 11/1957 | Middlemark . |
| 3,435,565 | 4/1969 | Blundell . |
| 4,030,247 | 6/1977 | Grund et al. . |
| 4,177,608 | 11/1979 | Balz . |
| 4,385,472 | 5/1983 | Balz . |
| 4,408,417 | 10/1983 | Kobayashi et al. . |

FOREIGN PATENT DOCUMENTS

| | | |
|---|---|---|
| 1652151 | 11/1975 | Fed. Rep. of Germany . |
| 3142868 | 6/1982 | Fed. Rep. of Germany . |
| 3332787 | 3/1985 | Fed. Rep. of Germany . |
| 3422478 | 12/1985 | Fed. Rep. of Germany . |
| 2046010 | 3/1971 | France . |
| 1391156 | 4/1975 | United Kingdom . |
| 436808 | 5/1976 | United Kingdom . |
| 2125307 | 7/1984 | United Kingdom . |

OTHER PUBLICATIONS

JP-A-57 205 067 (Toyota) & Patent Abstracts of Japan, Band 7, Nr. 59 (M-199) (1204) 11-03-1983.

Patent Abstracts of Japan, Band 7, R. 29 (M-191) (1174), Feb. 5, 1983; and JP-A-57 184 667 (Toyota Jidosha Kogyo K.K.) 13-11-1982.

*Primary Examiner*—Frederick R. Schmidt

*Assistant Examiner*—Maurina Rachuba

*Attorney, Agent, or Firm*—A. Thomas S. Safford

[57] ABSTRACT

Centrifugal treatment apparatus for mechanical treatment, e.g. grinding, polishing, cleaning and deburring of workpieces, including a workpiece receiving container, which has a mainly cylindrical casing (1) and a rotating base (2) in the form of a plate or similar, arranged coaxially thereto, whose circumferential rim abuts the cylindrical casing, the casing being removably attached to a support (3). The casing in accordance with the present invention is formed so that it can also be fixed in an inverted position with its upper rim on the support (3). In this way it is possible to use the container casing further in the inverted position after abrasion of its inner surface in the lower region, which results in the operating lifetime of the container casing being doubled or almost doubled.

16 Claims, 2 Drawing Sheets

CENTRIFUGAL TREATMENT APPARATUS

Figure 1:
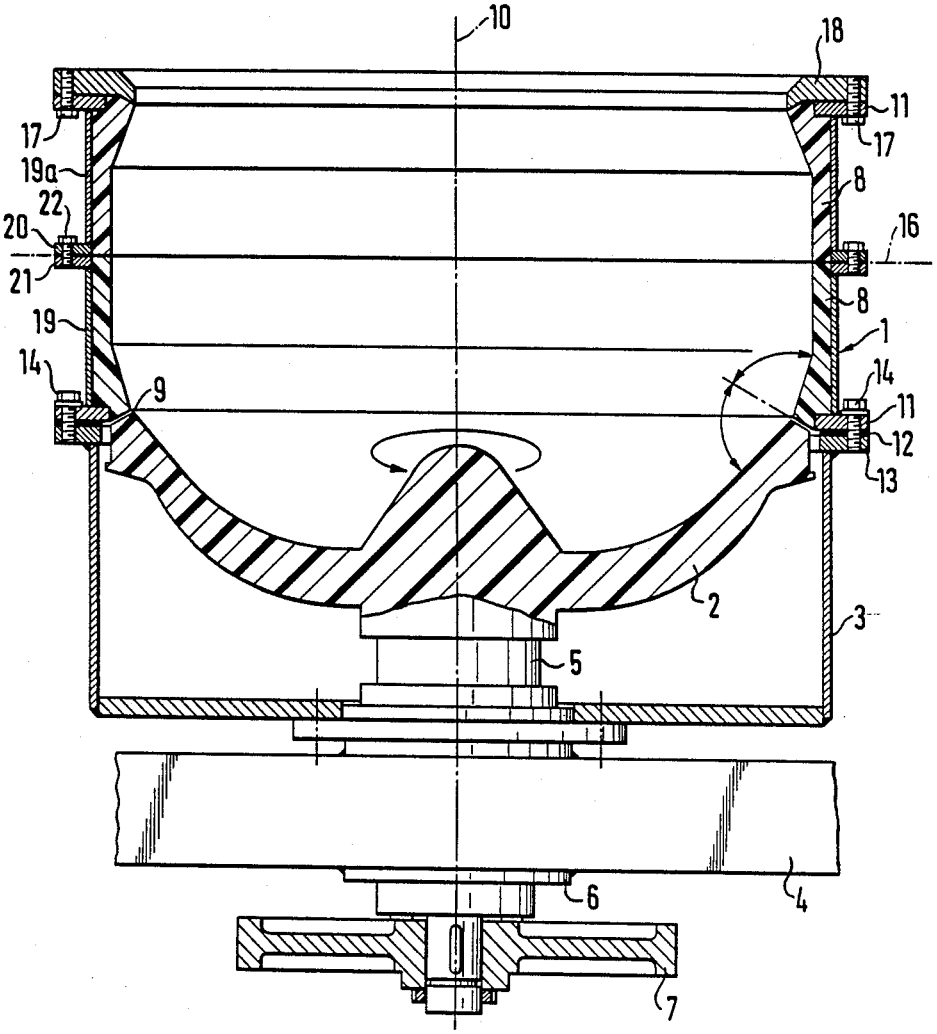

The invention relates to a centrifugal treatment apparatus for mechanical treatment e.g. grinding, polishing, cleaning and deburring of workpieces, including a workpiece receiving container which has a mainly cylindrical casing and a rotating base in the form of a plate or similar dished structure, arranged coaxially thereto, whose circumferential rim abuts the cylindrical casing, the casing being removably attached to a support.

Such a centrifugal treatment apparatus is already known (e.g. DE-OS-3142868). With this known apparatus a relatively large degree of abrasion occurs on the inside surface of the cylindrical casing, in particular in its lower region just above the rotating base. The reason for this is that the workpieces, to be treated in the workpiece receiving container and the treatment chips, added to effect the required mechanical treatment, are thrown with relatively high energy due to centrifugal force against this inside surface in the lower part of the casing, following which they rise up on this inside surface of the container and then fall back into the central region of the container or are pushed back by the following workpieces and treatment chips. Due to this localized abrasion the complete container casing becomes unusable relatively quickly and must be exchanged for a new one.

The invention has the object to considerably increase the relatively short operation time of the container casing of aforementioned known machines. This is achieved according to the present invention in that the casing of the workpieces receiving container is formed so that it can also be fixed in an inverted position with its upper rim on the support. It is thus possible to continue to use the container casing in the inverted position after abrasion of its inner surface in the lower region, by which method the lifetime of the container casing can be doubled or almost doubled.

In order to be able to fix the casing in the inverted position with its top rim downwards in the same way as with its bottom rim on the support, the same fixing means must be provided on a top rim of the casing as on the bottom rim of the casing. It is advantageous if the top rim is formed exactly in the same way as the bottom rim i.e. not only in its fixing means but also in its supporting surfaces. In order to reduce the abrasion of the inside surface of the casing further and therefore to increase its lifetime even further, it is advantageous if the inner surface of the casing is curved or bent in the axial cross-section towards the inner surface of the container base. It is, however, advantageous if the inner surface is curved without a discontinuity and in fact so that it joins to the inside surface of the container base substantially smoothly without a kink or a similar discontinuity. In this way an accumulation of the workpieces to be treated and the treatment chips at the discontinuities of the inner surface can be prevented with the result that there is a reduced abrasion of the inner surface in the region of such a discontinuity of kink. Further a more uniform treatment can be guaranteed for all workpieces which are in the container treatment at the same time.

In order to allow a most uniform and abrasion free return of the workpieces and treatment chips which have risen of the inside surface of the casing to the central region of the container, the inside surface of the casing is not only curved in the axial cross-section of the container towards the inside surface of the base but is also curved or bent inwards in the upper container area in the same way. With this arrangement it is particularly advantageous if the inner surface has the form of a curve free of discontinuities in the direction of the upper and lower rims of the container casing, the complete inner surface of the container casing having the form of a segment of a sphere.

The inner surface of the casing of the workpiece receiving container can, in the same way as the inside surface of its base, be formed from a plastic material for example polyrethane. In order to simplify the manufacture by molding and also the construction of the mold, it is advantageous that the casing is separated into identical halves along its middle plane which runs prependicular to the axis of the container, both halves being connected for example by bolts, screws or similar.

Figure 2:
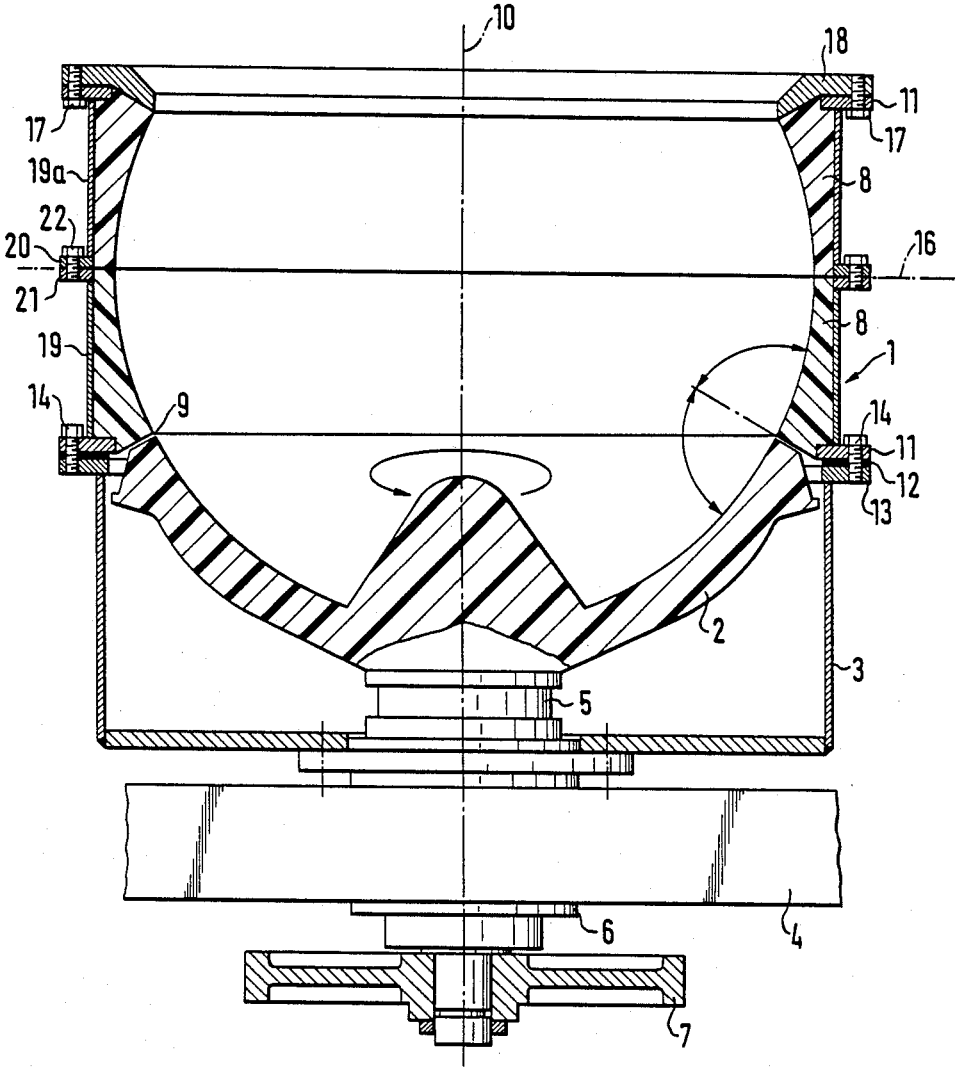

Further advantageous embodiments of the invention are given in the claims. Two advantageous embodiments of the machine according to the invention are shown in the drawings which are described in the following:

FIG. 1 shows the first embodiment in a longitudinal section through the workpiece receiving container and its support and drive means; and FIG. 2 shows the second embodiment in the same perspective as that according to FIG. 1.

In both of the embodiments shown, the workpiece receiving container is formed from an upper cylindrical casing 1 and a lower rotating dish-like base 2 which is joined coaxially thereto and which abuts the bottom rim of the casing with its circumferential rim. The cylindrical casing 1 rests on its lower rim on the upper rim of a support container 3, which is located underneath and which is joined in a non-rotatable manner to a support 4 or similar. The base 2 of the workpiece receiving container rests on a vertical shaft 5 which is located in a rotatable manner in the bearing 6 of the support container. The base 2 is made to rotate by a driving wheel 7 via a rotation shaft.

The cylindrical container casing 1 is provided with an inner coating 8 of plastic, the container base 2, which is also made of plastic, extends to the thickened lower rim of the container forming a narrow gap 9, which runs with an angle of about 60° to the axis 10 of the container and the shaft 5, so that no sharp edges occur on either side of the gap on the inner coating of the casing and the rim of the base. The relatively small inclination of the gap 9 which is thus formed with reference to the horizontal plane is advantageous for setting the width of the gap, as explained later, resulting from a vertical movement of the casing 1 of the workpiece receiving container in relation to its base 2.

On the bottom rim of the casing 1 of the workpiece receiving container a radial flange 11 is fixed, which projects beyond the outer surface of the container and which runs around the complete circumference of the container. The casing 1 of the treatment container rests with this flange 11 on a ring 12 of elastic material which is located between this flange 11 and on opposing flange 13, which is firmly welded to the upper rim of the support container. For fixing casing 1 on the support container 3, fixing screws 14 are provided in the flanges. It is possible to set the width of the gap 9 by tighting or loosening the fixing screws 14, which compresses or releases the ring 12. This adjustment capability is also advantageous when considering the unavoidable variation in production tolerances of both rims of the casing 1. Because the workpiece receiving container for treatment of the workpieces which are introduced thereto is filled normally with a liquid (compound), the ring 12 can also serve as the required seal between the two opposing flanges 11 and 13.

The casing 1 of the workpiece receiving container is formed symmetrically in respect to its middle plane 16, which is perpendicular to its axis 10. Its inner coating 8 increases in thickness in a similar manner towards its upper and to its lower rim. The upper rim with flange 11 is formed with holes for receiving the screws 17 in the same way as the lower rim. The screws 17 are also used to fix a protection ring 18 on the upper casing rim, which is designed to prevent damage to the upper edge of the inner coating 8 when filling and emptying the workpiece receiving container of workpieces, treatment chips and the same.

In order to simplify the manufacture of the casing 1 of the workpiece receiving container in the said symmetrical form, the casing is separated in its middle plane 16 into two equal parts 19, 19*a*, which are fixed together by screws 22 via flanges 20, 21, which project radially. In order to invert the two part casing 1 of the workpiece receiving container it is only necessary to remove the protection ring 18 with the fixing screws 17 on the upper casing rim and then loosen and remove the fixing screws 14 on the bottom casing rim. The casing can then be inverted with its previously upper rim turned downwards and supported on the flange 13 of the support container 3 and can be fixed with the fixing screws 14 to the support container.

According to the embodiment shown in FIG. 1, the inner coating 8 is so formed that its inner surface runs initially straight, parallel to the upper surface of the casing 1 starting from the middle plane 16 of the casing as shown in the longitudinal section through the casing in FIG. 1, and is then inclined to the vertical due to a thickening of the inner coating towards the casing rims. By this arrangement it is achieved that the inclination of the inner surface of the casing 1 in the region of the gap 9 has approximately the same angle to the axis of the gap as the inner surface of the base 2. Because each discontinuity, especially kinks in the inner surface of the casing and the base of the workpiece receiving container, results in increased abrasion and deterioration in the flow of the workpieces inside the container during operation of the machine, it is advantageous if inner coating, casing and base are formed with the least possible discontinuities and also that the inner surface of the casing is connected to the inner surface of the base in the region of the gap 9, without a discontinuity.

In the embodiment shown in FIG. 2 this is obtained in an optimal way. This embodiment differs from the previous one according to FIG. 1 only in the form of the inner coating of the casing 1 and the inner surface of the base 2. All similar parts have therefore the same reference numbers as in FIG. 1. The inner surface of the inner coating 8 of the workpiece receiving container has, in this embodiment, the form of a segment of a sphere, this inner surface being joined to the inner surface of the base 2 in the region of the gap 9 without a discontinuity or kink. In this way the inner surface of the casing and base of the workpiece receiving container, with the exception of the central base region, is formed without any kind of discontuity which could hinder the movement of the workpieces and treatment chips in the workpiece receiving container and therefore could result in a local increased abrasion of the inner surface. With this embodiment, as with the embodiment according to FIG. 1, an overhang of the inner coating 8 in the region of the upper rim of the casing 1 is provided, which allows the return to the central region of the container of those contents of the container which have risen up along the casing coating.

I claim:

1. Centrifugal treatment apparatus for mechanical treatment, e.g. grinding, polishing, cleaning and deburring of workpieces, comprising:

a workpiece-receiving container including a substantially cylindrical casing having upper and lower rims, and a rotating base in the form of a plate or similar dished structure arranged coaxially thereto and having a circumferential rim which abuts the cylindrical casing;

a support for said casing;

the casing being removably installable with its lower rim on the top of said support; and the casing of the workpiece-receiving container being formed so that it is also installable when inverted with its formerly-upper rim positioned on the top of said support.

2. Apparatus according to claim 1, wherein the upper rim of the casing of the workpiece receiving container is formed in the same way as the lower rim of the casing.

3. Apparatus according to claim 1, wherein the circumferential rim of the base abuts the lower rim of the casing.

4. Apparatus according to claim 1, wherein the casing of the workpiece-receiving container as a whole is formed symmetrically in relation to a middle plane thereof which runs perpendicular to a longitudinal axis of the casing.

5. Apparatus according to claim 1, wherein an inner surface of the casing of the workpiece-receiving container is curved or bent towards an inner surface of the base in a longitudinal cross-section through the workpiece-receiving container.

6. Apparatus according to claim 5, wherein the inner surface of the casing is curved over its entirety without discontinuity or kink.

7. Apparatus according to claim 6, wherein the inner surface of the casing of the workpiece receiving container has the form of a segment of a sphere.

8. Apparatus according to claim 5, wherein the inner surface of the casing joins the inner surface of the base essentially without a discontinuity or kink.

9. Apparatus according to claim 8, wherein a gap is formed between the circumferential rim of the base and the lowermost circumferential rim of the casing of the workpiece-receiving container, and said gap lies at an angle to a longitudinal axis of the workpiece-receiving container of between 30° and 20°.

10. Apparatus according to claim 9, wherein the inner surfaces of the casing and the base of the workpiece-receiving container run in a region close to the gap approximately vertically to an axis of the gap.

11. Apparatus according to claim 1, wherein the casing is separated into two similar parts along a middle plane thereof, which lies perpendicular to a longitudinal axis of the casing, said parts being connectable to each other.

12. Apparatus according to claim 11, wherein both said parts of the casing have connecting flanges which project away from the workpiece-receiving container, with which said parts are fixed together.

13. Apparatus according to claim 1, wherein the support is formed from a casing of a support enclosure which lies under the workpiece-receiving container and abuts the casing of the workpiece-receiving container with an upper rim thereto.

14. Apparatus according to claim 13, wherein the casing of the workpiece-receiving container is connected with the casing of the support enclosure by flanges projecting from abutting rims of said container casings, between which an elastic seal is located.

15. Apparatus according to claim 1, wherein the upper rim of the casing of the workpiece-receiving container is protected by a protection ring which is removably fixed to the upper rim of the casings.

16. Apparatus according to claim 1, wherein the casing and/or base of the workpiece-receiving container and/or inner coatings thereof consists of an abrasion resistant material.

* * * * *